US006546853B2

(12) United States Patent
Watanabe

(10) Patent No.: US 6,546,853 B2
(45) Date of Patent: Apr. 15, 2003

(54) BAND TIGHTENING AND CUTTING DEVICE

(75) Inventor: Kunihiko Watanabe, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/870,738

(22) Filed: Jun. 1, 2001

(65) Prior Publication Data

US 2001/0052182 A1 Dec. 20, 2001

(30) Foreign Application Priority Data

Jun. 2, 2000 (JP) ..... 2000-165424

(51) Int. Cl.[7] ..... B65B 13/24

(52) U.S. Cl. ..... 100/29; 100/33 PB; 140/93.2; 140/123.6

(58) Field of Search ..... 140/123.6, 93.2, 140/93 A; 100/33 PB, 29

(56) References Cited

U.S. PATENT DOCUMENTS 1,463,869 A * 8/1923 Campbell ..... 140/93 A
1,499,096 A * 6/1924 Campbell ..... 140/123.6
2,267,532 A * 12/1941 Moberg ..... 100/30
2,854,035 A * 9/1958 Moberg ..... 140/93.4
2,967,550 A * 1/1961 Rosenberger ..... 140/93 R
3,169,560 A * 2/1965 Caveney ..... 140/123.6
3,640,258 A * 2/1972 Isobe et al. ..... 123/365
4,119,124 A * 10/1978 Collier et al. ..... 140/123.6
5,522,436 A * 6/1996 Tabuchi et al. ..... 140/92.1
5,957,165 A * 9/1999 Watanabe et al. ..... 140/123.6

FOREIGN PATENT DOCUMENTS

| | | |
|---|---|---|
| JP | 6-336215 | 12/1994 |
| JP | 9-225888 | 9/1997 |
| JP | 10236424 | 9/1998 |
| JP | 11180408 | 7/1999 |

OTHER PUBLICATIONS

English Language Abstract of JP 10–236424.
English Language Abstract of JP 9–225888.

* cited by examiner

*Primary Examiner*—Allen Ostrager
*Assistant Examiner*—John S Goetz
(74) *Attorney, Agent, or Firm*—Greenblum & Bernstein, P.L.C.

(57) ABSTRACT

A vertical member having a sliding member and the like is installed on the upper face of a base member which covers a cutting blade in a condition in which the cutting blade can slide in a horizontal plane. An operational lever is provided to extend from the vertical member and a rotational member, having a fixed sandwiching member and a rotational sandwiching member, is installed on the vertical member perpendicular thereto and in a condition in which it can be freely rotated. The band part is fastened by rotating the rotational member in a condition in which the band part of a band is sandwiched by the fixed sandwiching member and the rotational sandwiching member, and the cutting blade is moved by downward movement of the sliding member to cut and remove the band part.

12 Claims, 8 Drawing Sheets

(A)

(B)

BAND TIGHTENING AND CUTTING DEVICE

BACKGROUND OF THE INVENTION

1. Field of the Invention

The present invention relates to the field of band tightening and cutting devices, and in particular, to a device for easily and safely winding and tightening a band around a number of electric wires, and cutting and removing an excess portion of the band.

2. Description of Related Art

A band is often used for bundling a number of electric wires. The electric wires may be used for connection between various kinds of electrical equipment mounted in a vehicle, such as an automobile, or in various kinds of electrical machinery and apparatuses, such as facsimile and copy machines. Generally, such a band includes a band portion that extends from a band base portion having a hooking hole. A band for bundling a number of electric wires may also be called a cable tie. Bundling electric wires with a band is accomplished by encircling the electric wires with the band portion, inserting an end of the band portion into the hooking hole and tightening the band around the electric wires, and cutting and removing an excess portion of the band.

FIG. 8 shows a conventional device and method for bundling a number of electric wires for a wire harness of an automobile. A group of electric wires D constituting a wire harness W/H wired on an assembly board Z is bundled with a band B. While various types of bands are known, a band having hooking blades B-3 at a band base portion B-1 with a band portion B-2 extending therefrom, and that may be installed on an automobile body panel, is shown in the conventional example.

A known device for banding a number of electric wires includes a plurality of wiring jigs 2 having U-shaped receiving portions for supporting electric wires, and a plurality of banding jigs 3 for applying bands to the electric wires, projecting from an assembly board Z. Each banding jig 3 includes a retaining board 3*b* on the upper end of a support bar 3*a* that projects from the assembly board Z, and a recessed portion 3*c* notched into one end of the retaining board 3*b*.

To secure a band around a bundle of electric wires, a tube C for protection is wound around the bundle to form a sheath on the outside of the electric wires D wired on the assembly board Z. A worker encircles the band portion B-2 of the band B around a portion of the bundle on which the tube is sheathed and inserts the band portion B-2 into the hooking hole of the band base portion B-1, then inserts the band B in the recessed portion 3*c* of the banding jig 3. Then, the band portion B-2 is tightened by pulling it while clamping the end of the band portion B-2 with pliers P, then an excess portion of the band portion B-2 that is unnecessary is cut with a nipper N.

As described above, the tightening of the band portion B-2 is performed by a worker who holds the pliers P by grasping, and the tightness of the band portion B-2 depends on the particular workers. Accordingly, the tightness of the band portion B-2 may differ by every worker, and it becomes difficult to maintain a consistent level of product quality. Occasionally, the tube C may be destroyed by over-tightening the band portion B-2. Further, if the pliers P happen to be pulled off the band portion B-2 during tightening, the surroundings may be damaged by the pliers P, and there is a fear that the workers themselves may be injured.

Additionally, considering the above-mentioned banding method from the standpoint of work efficiency, the worker is required to use the pliers P for pulling the band portion B-2, and to use the nipper N for cutting. Therefore, the exchange of holding the nipper N in place of the pliers P is required, the work cannot be continuously performed, and the method is troublesome.

SUMMARY OF THE INVENTION

In order to solve the above problems in the prior art, the present invention includes a tightening and cutting device for fastening and cutting a band that bundles a group of electric wires forming a wire harness.

The present invention is directed to a band tightening and cutting device. An object of the invention is to provide a band tightening and cutting device that provides a consistent amount of band tightening, even if the band tightening is performed by different workers. Another object of the invention is to provide a band tightening and cutting device that maintains a consistent level of product quality. Another object of the invention is to provide a band tightening and cutting device that does not require the worker to exchange the holding of tightening and cutting tools. Another object of the invention is to provide a band tightening and cutting device that provides improved operation efficiency. Further, another object of the invention is to provide a band tightening and cutting device for assembling a wire harness for an automobile.

According to an aspect of the present invention, a tightening and cutting device is provided for fastening and cutting a band that bundles a group of electric wires forming a wire harness including a base member having a band-retaining portion on the upper end of a support bar that projects from an assembly board provided at a location on the assembly board corresponding to a bundling location on the assembly board where a band is fastened around a group of electric wires wired on the assembly board. The base member has a band holding member, a band pulling mechanism that may be rotated in a direction so that the band holding member is moved upward, and a cutting blade that is movable to a band retaining portion side of the base member in response to the rotation of the band pulling mechanism. Furthermore, a band base portion of the band is retained by the band-retaining portion and the end of the band portion encircling the electric wires is held by the band holding member, and the band is fastened around the electric wires at a certain location by fastening the band portion and cutting an excess portion of the band.

Thus, when the tightening and cutting device for fastening and cutting a band of the present invention is provided extending from an assembly board, the device of the present invention can be used as a band fastening jig so that the band is positioned against a group of electric wires forming the wire harness and secured around the electric wires. Further, since all of the bundling, tightening and cutting steps can be performed with the device of the present invention, the exchange of holding tools is unnecessary, and the banding operation can be more efficient.

According to a further aspect of the present invention, the band-retaining portion is formed by notching an end part of the base member.

In another aspect of the present invention, the band pulling mechanism includes a substantially L-shaped member having a vertical member and a horizontal member provided on the upper face of the base member, and a rotational member mounted on said vertical member in a freely rotatable manner.

According to a further aspect of the present invention, the device includes a sliding member provided on the horizontal member of the substantially L-shaped member movable in an upward and a downward direction, wherein the sliding member includes a pressure member, and the band holding member and the pressure member are provided on the rotational member.

According to a further aspect of the present invention, the cutting blade may have a cam part on an upper side and may be housed and slidable in a recessed portion in the base member so as to be linked with the band-retaining portion, in a manner in which the cutting blade can slide, and the band portion is pulled by the rotation of the rotational member, the sliding member is moved in a downward direction by the pressure member in response to rotation of the rotational member and contacts the cam part of the cutting blade, and the cutting blade is moved to the band-retaining portion side of the base member to cut an excess portion of the band.

In a further aspect of the invention, the rotational member is rotated, the cutting blade is moved to the band-retaining portion side of the base member by the pressure member by the sliding member, and the band portion may be cut. Therefore, a worker can simultaneously tighten, fasten and cut the band by only rotating the rotational member, the burden on the worker is reduced, and the bundling operation can be easily performed.

According to another aspect of the present invention, the substantially L-shaped member is rotatably mounted on the base member and biased by a spring in a direction in which the band-retaining portion is closed, and the substantially L-shaped member may be rotated against the biased direction to an open position to insert the band base portion of the band in the band-retaining portion. Thus, the insertion and retention of the band base portion may be performed smoothly. Further, during fastening of the band portion, the substantially L-shaped member is biased by the spring to a closed position, the band portion may be pulled in an upward direction, and the band portion may be tightened and fastened.

In a further aspect of the present invention, a lever extends from the rotational member and an adjustable stopper is provided on the rotational member, and the lever contacts the adjustable stopper during the rotation of the rotational member to control the amount of rotation of the rotational member. Thus, when the lever extends from the rotational member, a worker may grasp the lever and rotate the rotational member with little effort. Further, the adjustable stopper that is contacted by the rotated lever is provided on the substantially L-shaped member so that the amount the rotational member rotates can be controlled. Therefore, the amount the rotational member rotates and the tightness of the band portion can be predetermined and do not depend on the particular operator of the device, and the product quality control can be improved. Further, any overtightening of the band and resulting collapse of the protective material around the bundle of wires due to overtightening of the band can be avoided.

According to a further aspect of the invention, a detection probe may be provided in the notched portion of the block for detecting insertion of a band base portion into the band-retaining portion. The detection probe recognizes the presence or absence of the band base portion during operation, and the problem of forgetfulness of the operators can by avoided.

In a further aspect of the present invention, the band-retaining portion includes a pair of generally triangular shaped protrusions extending from a lower face of the base member, a notched portion on an end of the base member between said pair of generally triangular shaped protrusions, and a block provided on the lower face of the base member. The block includes a pair of generally triangular shaped protrusions and a notched portion therebetween, the notched portion being coextensive with said notched portion of said base member, and the pair of generally triangular shaped protrusions on the block are spaced from the pair of generally triangular shaped protrusions on the base member so that blade parts of a band are receivable in the space and a band base portion of a band is receivable in the notched portions to hold the band for tightening and cutting.

According to a further aspect of the present invention, the band holding member includes a fixed holding member provided on the rotational member and including a pressure face, a rotational holding member rotatably mounted on the fixed holding member and including a pressure face, a spring having one end fixed to the rotational member and another end fixed to the rotational holding member, so that the spring biases the pressure faces together to hold a band portion therebetween.

In a still further aspect of the present invention, the L-shaped member includes a recessed portion provided on the vertical member and a recessed portion provided on the horizontal member adjacent the notched portions. A U-shaped shaped guide member is provided on the vertical member in the recessed portion of the vertical member and the recessed portion of the horizontal member, the U-shaped guide member having an insertion guide portion that guides the band portion during the band tightening operation.

According to a further aspect of the present invention, a method is provided for fastening and cutting a band that bundles a group of electric wires forming a wire harness. The method includes providing a band tightening and cutting device, providing a band having a band portion and a band base portion, and inserting the band base portion in a band retaining portion of the band tightening and cutting device. The method further includes encircling a group of wires with the band and inserting an end of the band portion into the band base portion, holding the band portion with a holding member of the band tightening and cutting device, and rotating the holding member and the band portion held thereby so that the band portion is pulled away from the band base portion and the band is tightened around the wires.

In a further aspect of the present invention, the method includes moving a cutting blade on the band tightening and cutting device in response to the rotating and thereby cutting an excess portion of the band, so that fastening and cutting of the band take place in a single operation.

BRIEF DESCRIPTION OF THE DRAWINGS

The above and other objects, features and advantages of the present invention will be made apparent from the following description of the preferred embodiments, given as non-limiting examples, with reference to the accompanying drawings, in which.

DETAILED DESCRIPTION OF THE INVENTION

Figure 1:
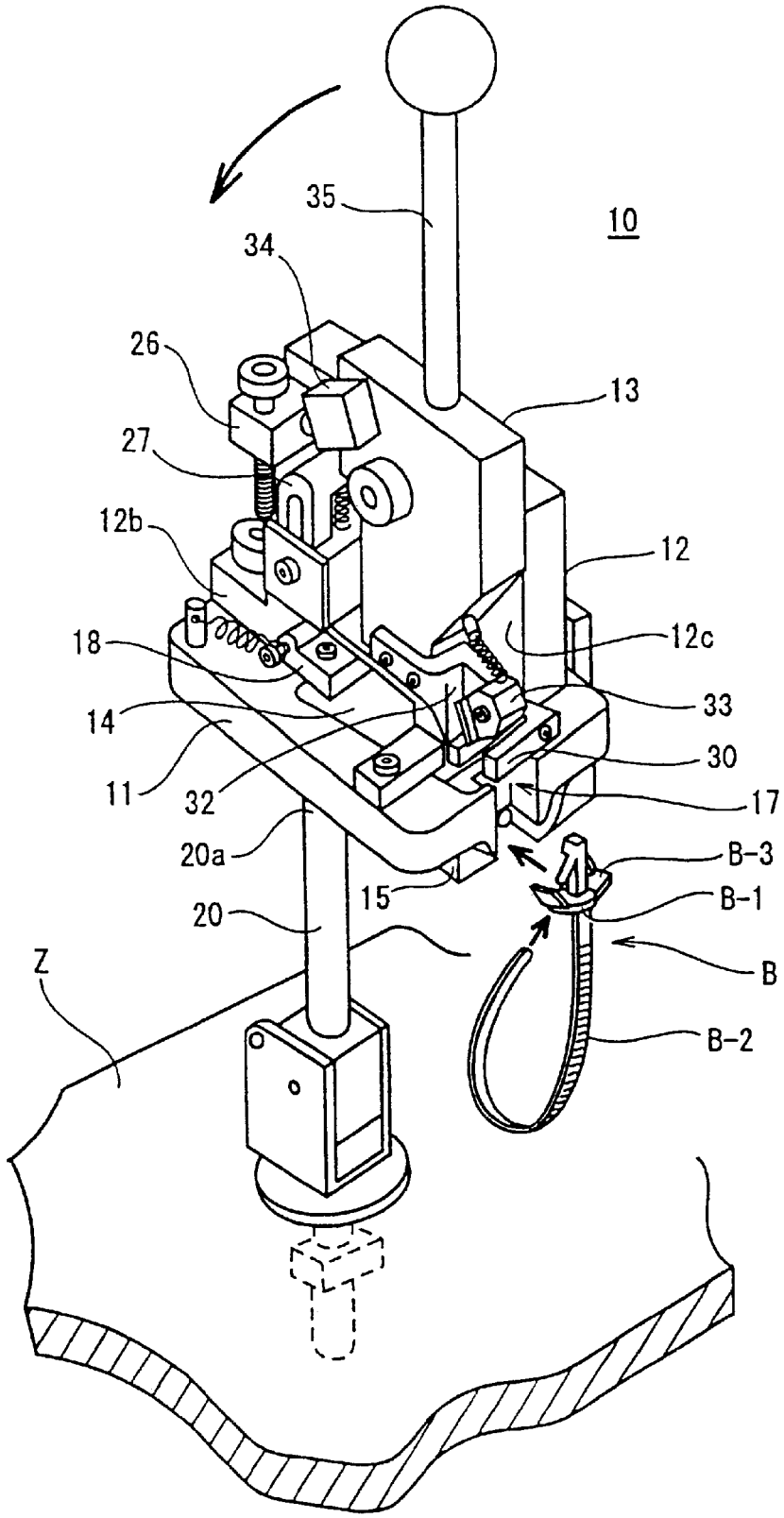
FIG. 1 is a perspective view of the band tightening and cutting device, according to an aspect of the present invention.

FIGS. 1, 2(A), 2(B) and 2(C) show a band tightening and cutting device 10 of the present invention. The band tightening and cutting device may be provided on an assembly board Z which may be used for assembling wire harnesses. The band tightening and cutting device 10 includes a base member 11 on the upper end 20*a* of a support bar 20 that projects from the assembly board Z. A band pulling mechanism including a vertical member 12 and a rotational member 13 are provided on the base member 11 for the band tightening and pulling procedure. Further, the support bar 20 may be provided on an area of the assembly board Z corresponding to a bundling area of the electric wires which are wired on the assembly board Z.

Figure 3:
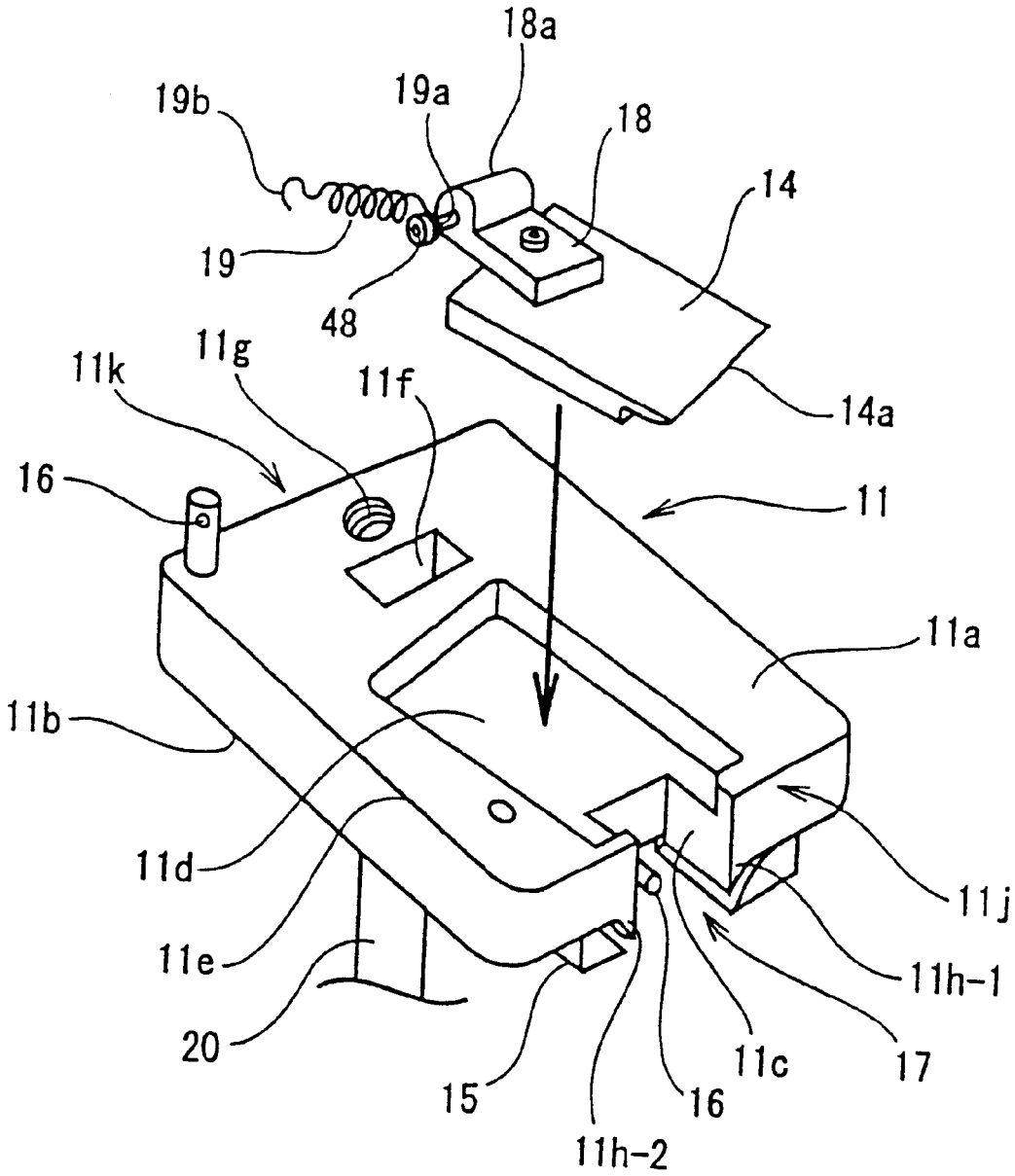
FIG. 3 is a perspective view showing the installation of a cutting blade to a base member, according to an aspect of the present invention.

As shown in FIG. 3, the base member 11 includes a hollowed out recessed portion 11*d* for storing the cutting blade 14 approximately at the center of the upper face 11*a* of the base member 11. The upper face 11*a* includes flat material having a uniform thickness. The recessed portion 11*d* holds the cutting blade 14 not in parallel but at an oblique angle relative to the edge 11*e* in the longitudinal direction of the base member 11 so that the cutting blade 14 forms an oblique angle with the band B to be cut. Further, the base member 11 includes a notched portion 11*c,* formed by notching the center of one end portion 11*j,* at the front of the base member 11, and generally triangular shaped protrusions 11*h*-1, 11*h*-2 are provided to extend from the left and right end portions of the lower face 11*b* of the notched portion 11*c*. Further, a square hole 11*f* extending through the base member 11, and a screw hole 11*g,* are provided on the opposite end 11*k* of the base member 11 from the notched part 11*c,* and a spring stopping bar 16 is provided protruding from one corner of the end 11*k* at the rear of the base member A resin block 15 is provided on the lower face 11*b* of the base member 11, and the upper end 20*a* of the support bar 20 is fixed to the resin block 15. Further, at the notched portion 11*c* of the base member 11, the resin block 15 is notched to have a shape aligned with the notched portion 11*c,* forming an opening portion 15*a* that is provided with left and right end portions that are notched, so as to be parallel to the oblique plane of the protrusions 11*h*-1, 11*h*-2 of the base member 11. A band-retaining portion 17 for receiving and retaining the band base portion B-1 of the band B is formed by the notched portion 11*c* of the base member 11 and the opening portion 15*a* of the resin block 15.

Figure 2:
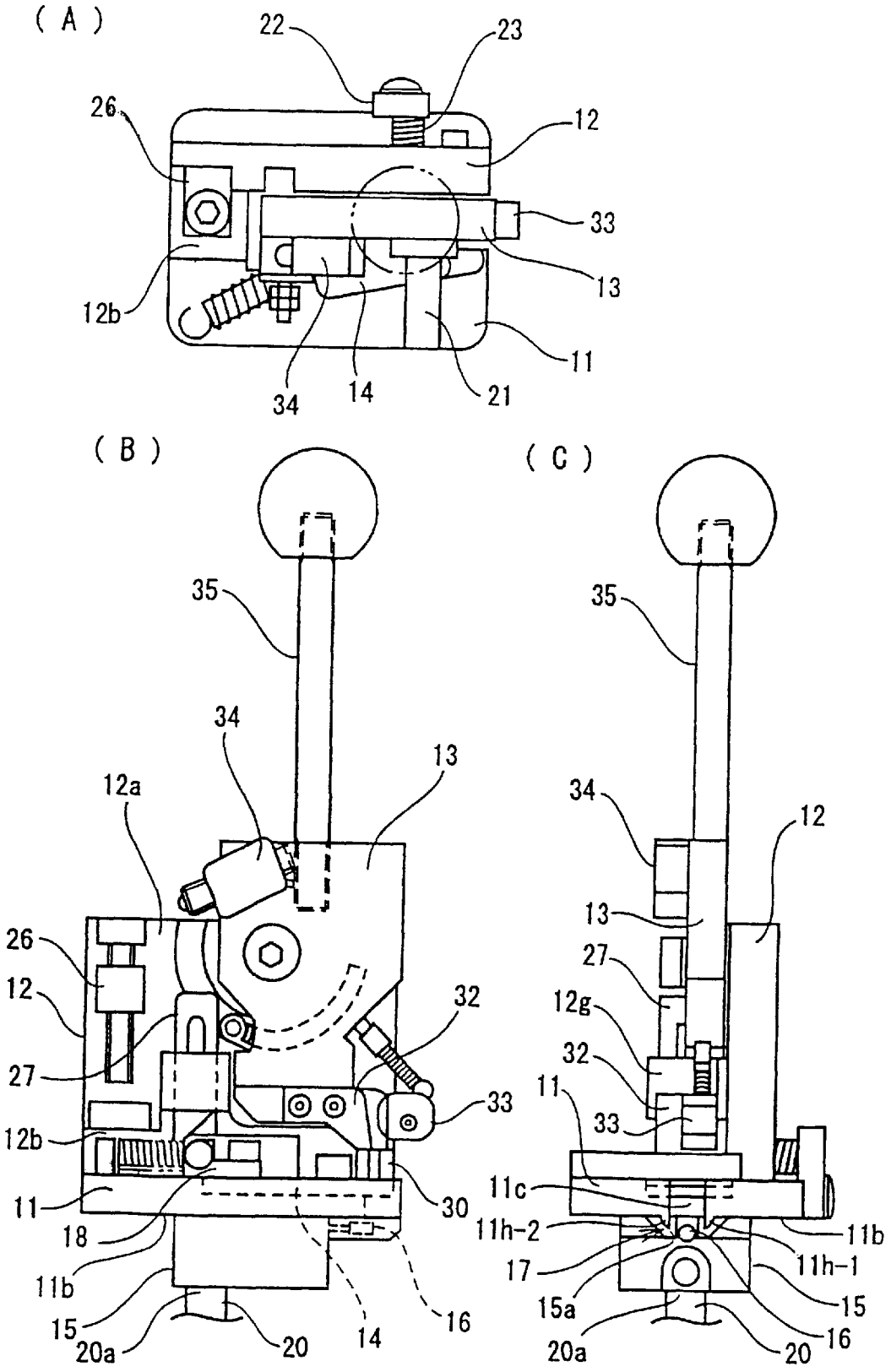
FIG. 2(A) is a top view.
FIG. 2(B) is a side view.
FIG. 2(C) is a front view of the band tightening and cutting device of FIG. 1.

As shown in FIG. 1, the band B may include blade parts B-3 for clipping positioned on opposite sides of the band base portion B-1. The blade parts B-3 may be inserted between the protrusions 11*h*-1, 11*h*-2 and the opening portion 15*a* as shown in FIG. 2(C). Further, the band portion base B-1 may be received and housed in the notched portion 11*c,* and the band B may be retained by the band-retaining portion 17. Further, a detection probe 41 may also be provided as a detector on the resin block 15 projecting into the opening portion 15*a*.

As shown in FIG. 3, the cutting blade 14 housed in the recessed portion 11*d* of the base member 11 includes the blade part 14*a* for cutting the band portion B-2 of the band B. The cutting blade 14 is formed by accurately forming the thickness of the edge into a thin, flat shape. The thickness and width dimensions of the cutting blade 14 are such that the cutting blade 14 can slide smoothly without becoming loose when housed in the recessed portion 11*d,* and the length dimension of the cutting blade is smaller than the longitudinal dimension of the recessed portion 11*d* so that the cutting blade 14 may move back and forth in the recessed portion 11*d*.

Further, a cam couple driving member 18 is provided on the rear part of the upper face of the cutting blade 14 and protrudes therefrom. The cam couple driving member 18 includes a cam part 18*a* protruding from the rear part thereof, and the cam part 18*a* includes an upper cam face in the shape of a smooth curve. Further, a screw 48 is provided on a side face of the cam part 18*a,* and one end portion 19*a* of a coil spring 19 is hooked on the screw 48.

Figure 4:
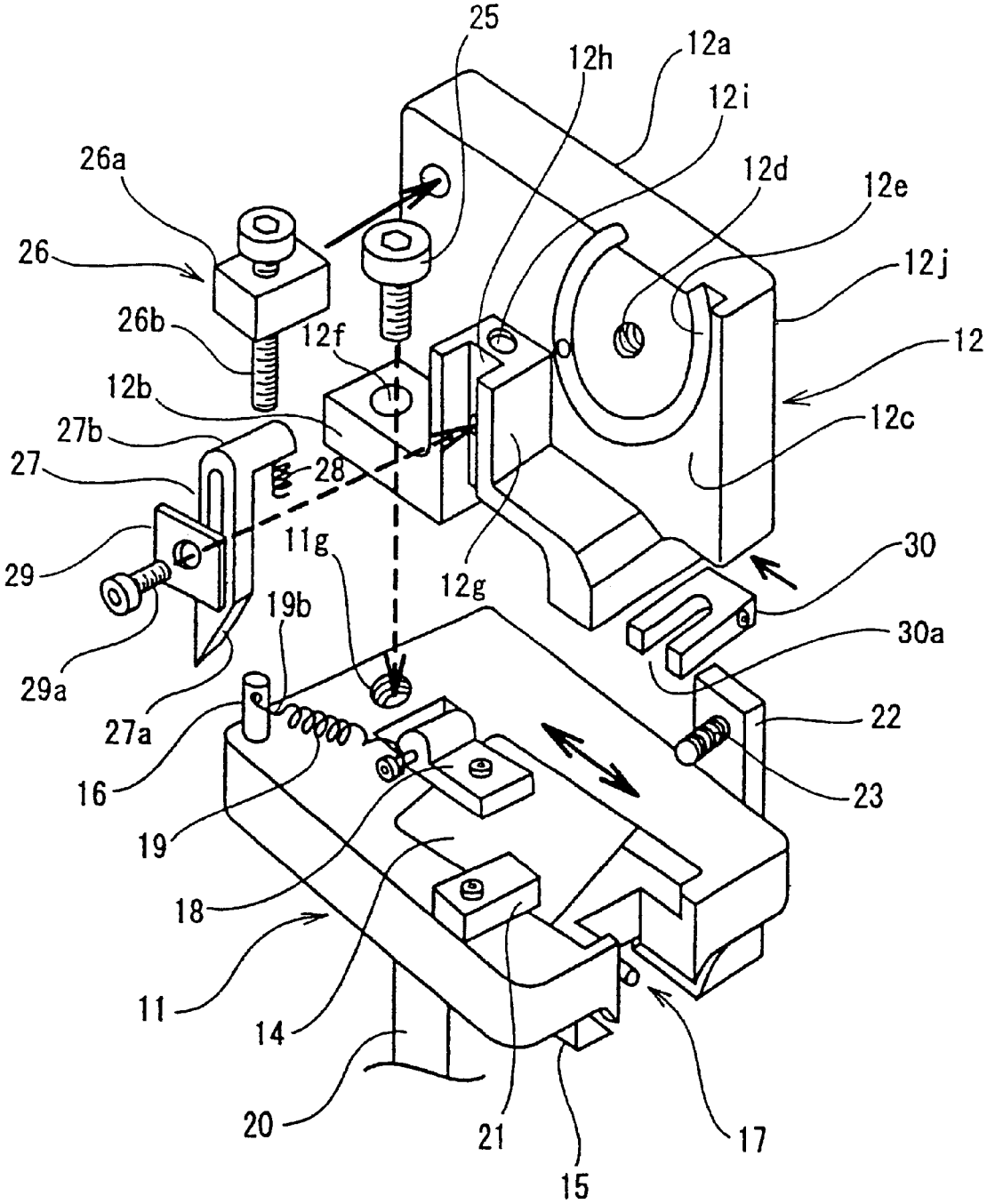
FIG. 4 is a perspective view showing the installation situation of a vertical member to a base member, according to an aspect of the present invention.

As shown in FIG. 4, the cutting blade 14 does not protrude above the upper face 11*a* while being housed in the recessed portion 11*d,* an end portion 19*b* of the extension coil spring 19 is hooked on the spring stopping bar 16 so that the cutting blade 14 is biased rearwardly. A blocking piece 21, which prevents ejection of the cutting blade 14 from the recessed portion 11*d* and acts as a stopper for the member 12, may be provided on the upper face 11*a* of the base member 11. Further, a stopper 22 on the opposite side of the member 12 is provided on one side face of the base member 11, and a compression coil spring 23 for biasing the member 12 is provided on the stopper 22.

The member 12 provided on the base member 11 has a vertical portion 12*a* and a horizontal portion 12*b,* and is formed to have a substantially L-shaped cross-section except for a central portion in the longitudinal direction. A screw hole 12*d* for installation of the rotational member 13 is provided on one side face 12*c* of the vertical portion 12*a,* and an arcuate groove 12*e* is provided with the screw hole 12*d* at its center. Further, the horizontal part 12*b* includes a through hole 12*f,* which is a pivoting center, on the upper face of an end part in the rearward direction, and a pillar holder portion 12*g* protrudes from a central part thereof. A longitudinal groove 12*h* is provided on the outer face of the pillar holder portion 12*g,* and a spring retaining hole 12*i* is provided on the upper face.

Further, the lower face of the member 12 includes a recessed portion (not numbered) extending from the lower end of the pillar holder portion 12*g* towards the front that prevents interference between the cutting blade 14 and the cam couple driving member 18, and provides smooth movement of the cutting blade 14. Further, a front recessed portion (not numbered) is provided on the lower part of the front of the vertical part 12*a* adjacent the front of the horizontal part 12*b,* providing an opening corresponding to the notched portion 11*c* of the base member 11. A guide member 30 having an approximate U-shape with a central cavity or insertion guide portion 30*a,* which guides the band portion B-2 of the band B, is provided on the member 12 in the front recessed portion.

A screw 25 penetrates the member 12 through the hole 12*f* of the horizontal part 12*b,* fastens into the screw hole 11*g* of the base member 11 so that the member 12 is installed on the base member 11 in a manner in which it can freely rotate horizontally, centered around the through hole 12*f*. Further, the compression coil spring 23 on the stopper 22 of the base member 11 pushes against the side face 12*j* of vertical member 12*a* to bias the member 12 into contact with the block piece 21 of the base member 11, thereby positioning the guide member 30 at the top of the band-retaining part 17.

Figure 7:
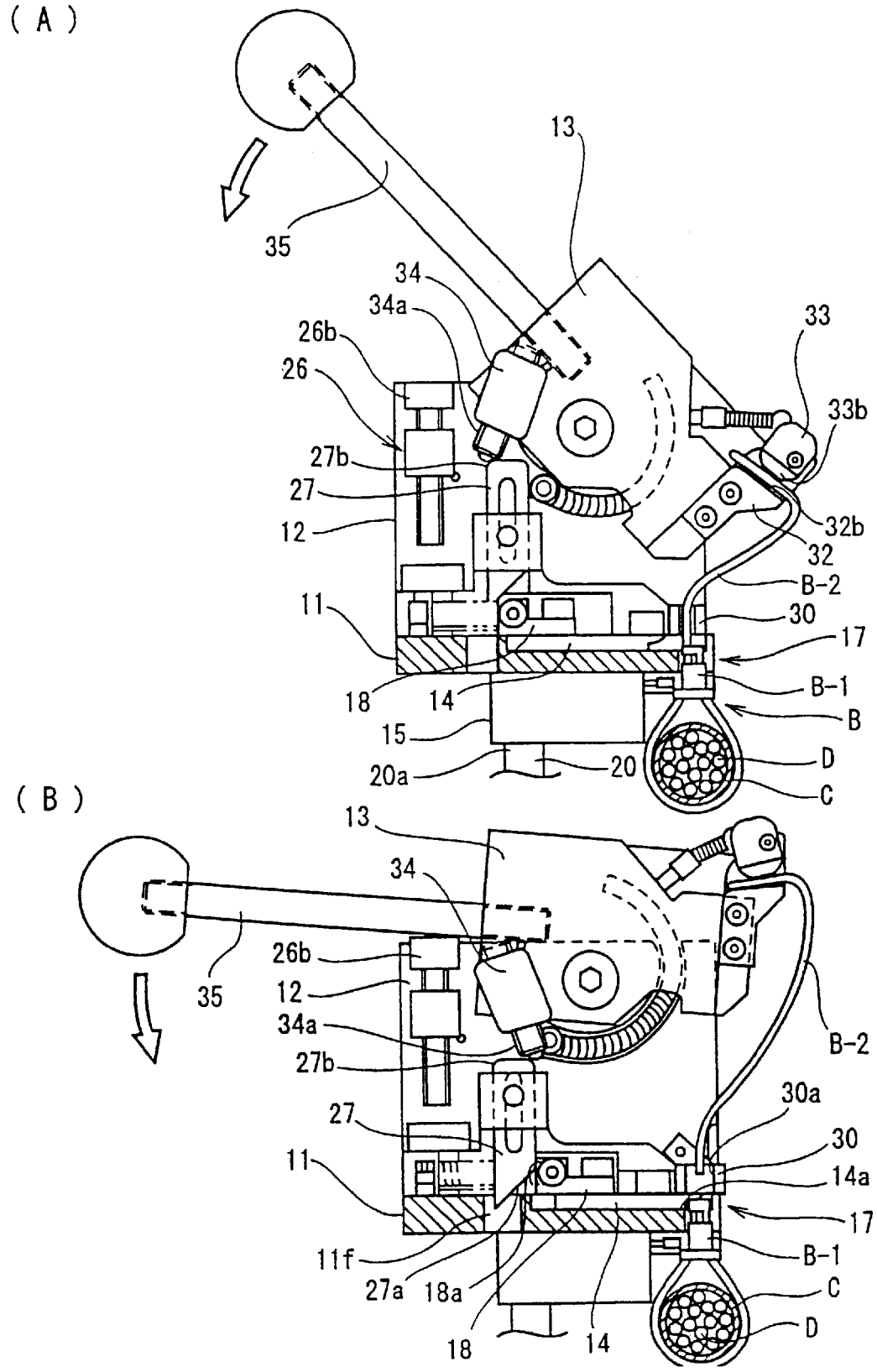
FIG. 7(A) is a side sectional view showing the fastening of a band portion.
FIG. 7(B) is a side sectional view showing the cutting of a band portion in which the fastening is completed.
Figure 8:
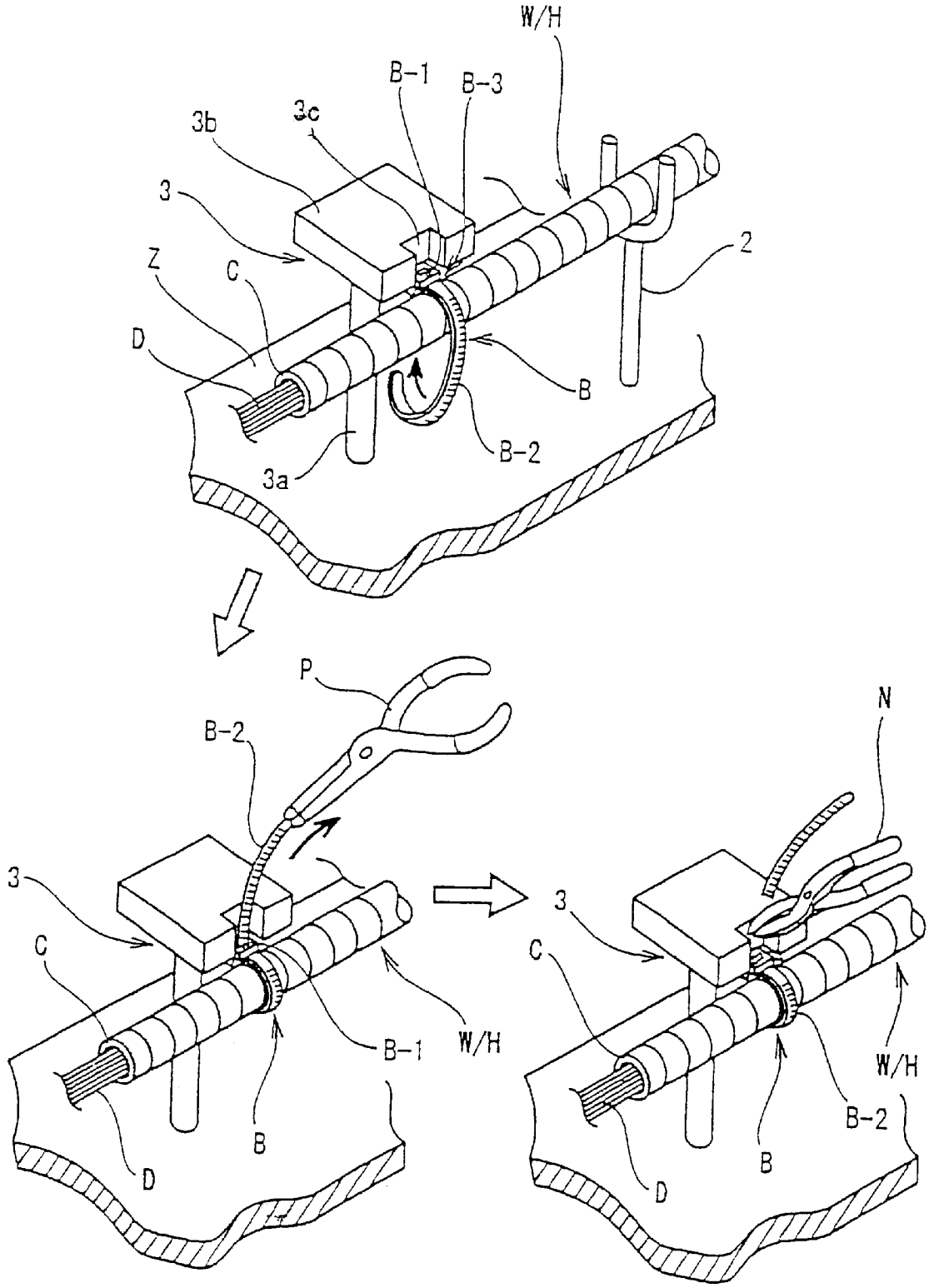
Fig.8 PRIOR ART
FIG. 8 is a schematic view showing a conventional sequential band tightening and cutting operation.

Further, a rotational stopper 26 is provided on the rear upper end of the side face 12*c* of the vertical member 12*a* in any suitable manner, such as by adhesive, welding, or mechanical fastening, and functions as a stopper for regulating rotation of the rotational member 13, as shown in FIG. 7B. The rotational stopper 26 includes a threaded hole for an adjusting bolt 26*b* in the block shape bracket 26*a*. By turning the adjusting bolt 26*b* in the threaded hole, the amount that the bolt 26*b* protrudes upward from the bracket 26*a* is changed. This changes the stop position of rotational member 13.

Further, a sliding member 27 that contacts the cam couple driving member 18 of the cutting blade 14 is provided in the longitudinal groove 12*h* of the pillar holder portion 12*g* in a manner in which it slides freely in the vertical direction. The sliding member 27 includes an oblique lower end 27*a* that is brought in contact with the cam part 18*a* of the cam couple driving member 18, and the upper end 27*b* has an increased thickness that holds a spring 28, and its upper face is formed in a smooth convex curved face. The lower end of the spring 28 is provided in the spring retaining hole 12*i* of the pillar holder portion 12*g* so that the spring 28 biases the sliding member 27 upward.

A stop panel 29 is mounted by a bolt 29*a* on the side face of the pillar portion 12*g*, and the sliding member 27 is held thereby in the longitudinal groove 12*h*.

Figure 5:
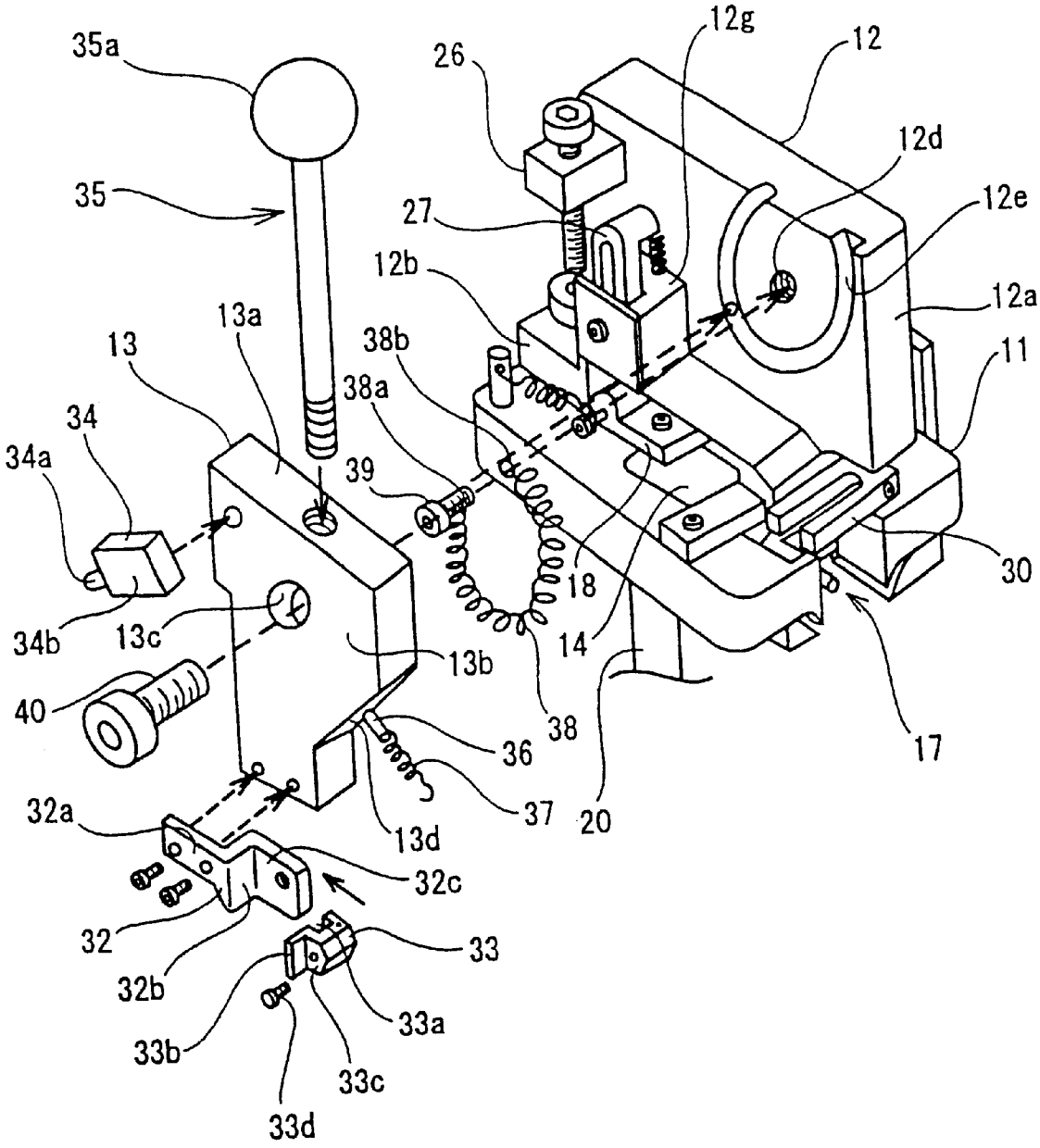
FIG. 5 is a perspective view showing the installation situation of a rotational member to a vertical member installed on a base member, according to an aspect of the present invention.

On the other hand, as shown in FIG. 5, the rotational member 13 is a flat element having a uniform thickness, and is formed in a shape having eight corners by notching the periphery so as to prevent interference with the pillar holder portion 12*g* of the member 12 and the like. The rotational member 13 includes an operating lever 35 having one end provided with the spherical part 35*a* as the holding member for a worker, and the other end is connected to the upper face 13*a* by, for example, a threaded connection. The rotational member 13 includes a rotational through hole 13*c* at a central part of the side face 13*b,* and includes a pressure member 34 mounted on the rear upper part in any suitable fashion, for example, by adhesive, welding, or mechanical fastening.

The pressure member 34 includes the pressure piece 34*a* protruding therefrom. The amount the pressure piece 34*a* protrudes from the block shaped base portion may be adjusted in any suitable manner, for example, by threading with the pressure member 34. As shown in FIGS. 7A and 7B, rotation of the rotational member 13 brings the pressure piece 34*a* into contact with the sliding member 27. Further rotation moves the sliding member 27, which contacts the cam driving member 18 and operates the blade 14.

Further, a fixed sandwiching or holding member 32, having a rotational sandwiching or holding member 33, is provided on the lower end of the rotational member 13, for sandwiching the band therebetween. The fixed holding member 32 has a shape obtained by bending a flat element twice, with one end 32*a* provided for mounting on the rotational member 13, the intermediate bent portion forms a pressure face 32*b* for holding the band, and another end 32*c* is provided for mounting the rotational holding member 33 thereon.

The rotational holding member 33 is configured as a small block provided with the hollow groove 33*a* for installation on the end 32*c* of the holding member 32. The rotational holding member 33 is provided with a holding part 33*b* extending from the side face 33*c* so as to confront the pressure face 32*b* of the fixed holding member 32. The rotational holding member 33 receives the end 32*c* of the fixed holding member 32 in the groove 33*a,* and is secured to the end 32*c* by the screw 33*d* in a manner in which the rotational holding member 33 freely rotates. Further, the end of an extension coil spring 37 is provided on a spring stopping bar 36, which extends from the oblique face 13*d* of the rotational member 13, provided on the rotational holding member 33 which is installed as described above so that the holding part 33*b* of the rotational holding member 33 is biased toward the pressure face 32*b*.

The rotational member 13 is fastened to the vertical member 12*a* by the installation bolt 40 through hole 13*c* and into screw hole 12*d* for the rotation. An end part 38*b* of the extension coil spring 38 is connected to rotational member 13. The spring 38 is provided in the arcuate groove 12*e* of the vertical member 12*a*, with one end 38*a* fixed with the bolt 39. The bolt 39 is fixed in a hold (not numbered) in the arcuate groove 12*e*, as shown in FIG. 5.

In the above-described configuration, the rotational member 13 is biased by the extension spring 38 in a direction in which the fixed holding member 32 and the rotational holding member 33 are situated downward. Thus, the band fastening and cutting device 10 shown in FIG. 1 and FIGS. 2(A), (B), (C) is completed.

Hereinafter, the band tightening and cutting device 10 of the present invention is further described below according to the fastening and cutting operation of the band B.

Figure 6:
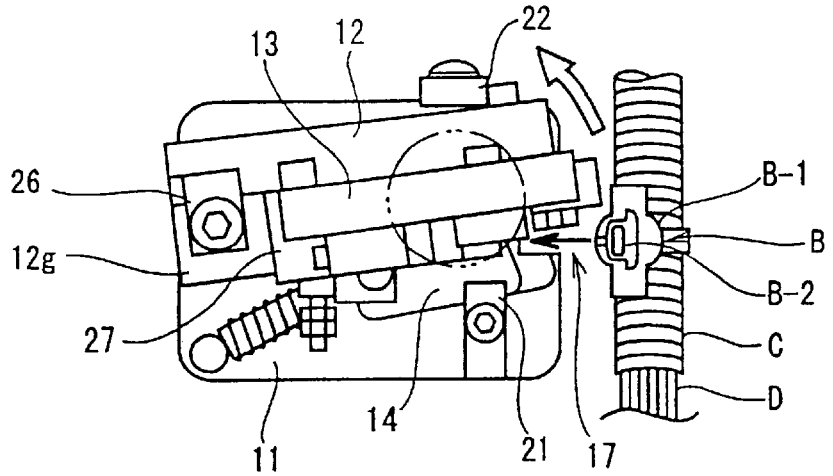
FIG. 6(A) is a plan view showing the insertion of a band to the band tightening and cutting device of the present invention.
FIG. 6(B) is a side sectional view of the band tightening and cutting device of the present invention.
Figure 6:
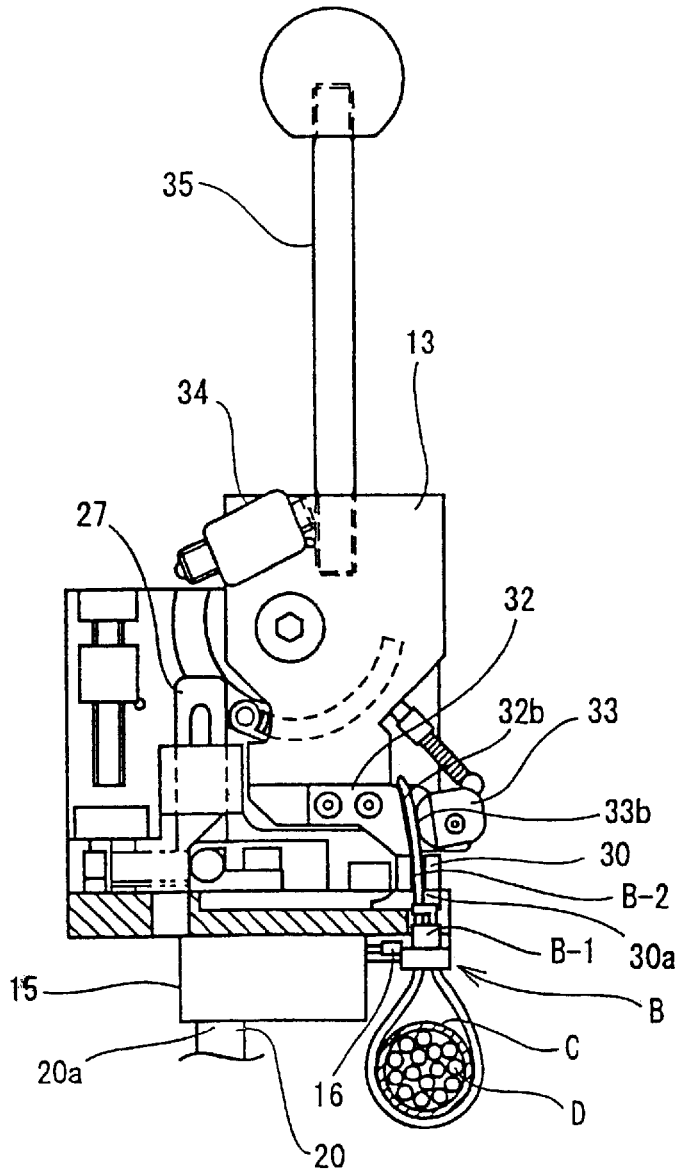

Firstly, the band B is inserted into the band-retaining portion 17 by encircling the band portion B-2 around a number of electric wires D which are sheathed with the corrugate tube C, and by inserting and passing the end of the band portion B-2 into the hooking hole of the band base portion B-1. Then, as shown in FIG. 6(A), since the member 12 is biased in the direction of closing the band-retaining portion 17, the band B is held in the band-retaining portion 17, after releasing the vertical member 12 from the position in which the vertical member 12 is rotated in the direction of the arrow until contacting the stopper 22. Further, the probe 41 in the band-retaining portion 17 is pushed by the band base portion B-1 to the inserted position, and detects the insertion of the band B. After the band B is inserted as described above, the band-retaining portion 17 is closed when the member 12 is returned in the biased direction. The band portion B-2 is positioned within the insertion guide portion 30*a* of the guide member 30 of the member 12 as shown in FIG. 6(B), and the edges of the band portion B-2 are sandwiched by the pressure face 32*b* of the fixed holding member 32 and the rotational holding member 33.

As shown in FIG. 7(A), when the operational lever 35 is rotated from the upright position in the direction of the arrow, the band portion B-2 is pulled and tightened around the corrugated tube C. Further, the pressure piece 34*a* of the pressure member 34 of the rotational member 13 is in a position in which it contacts the upper end 27*b* of the sliding member 27.

Further, as shown in FIG. 7(B), when the rotational member 13 is further rotated downward, the band portion B-2 is further pulled to tighten around the corrugated tube C, and moreover, since the pressure piece 34*a* also moves downward, it pushes downward the sliding member 27 against the bias of the spring 28. Then, the oblique lower end 27*a* of the sliding member 27 presses the cam part 18*a* of the cam couple driving member 18 fixed on the cutting blade 14, thereby moving the cutting blade 14 toward the band retaining portion 17.

Once the operational lever 35 contacts the head portion of the adjusting bolt 26*b* of the rotational stopper 26, the rotational member 13 cannot rotate any farther, thus preventing the over tightening and pulling of the band portion B-2, and tightens the band portion B-2 on the corrugate tube C with the desired bundling force. Further, in this position, the pressure piece 34*a* of the rotational member 13 is positioned at the lowest limit, and has pushed the sliding member 27 downwardly. Thus, the cutting blade 14 moves to the band-retaining portion 17 side of the base 11, and cuts the band portion B-2 with the edge of the blade part 14*a* at the upper face of the band base portion B-1. As the band portion B-2 is sandwiched by the rotational member 13, the band portion B-2 is removed, simultaneously with the cutting. Accordingly, by only the above-mentioned operation, the band B is rapidly bundled on a group of electric wires D in an appropriate manner and with a desired bundling force, and cutting is also performed.

Further, in the device and method discussed above, the application of the band tightening and cutting device 10 was described with reference to a wire harness for an automobile, but the present device may be used to apply a band to a group of electric wires used for connection between various kinds of electrical machinery and apparatuses, such as copy machines and the like. Further, the present device is not limited to the above-mentioned mode of operation, and an operational lever or the like may be provided extending from a base material instead of extending from the assembly board of a wire harness, and a band may be applied by freely carrying the band to the installation site, such as by carrying and holding the band in a tool, or a nipper or the like.

As described above, when the tightening and cutting device of the present invention is used, the fastening of the band portion of a band is carried out in accordance with the rotation of a rotational member; and, the rotational range of the rotational member is regulated by a rotational stopper. Accordingly, an appropriate and desired tightening amount of the band portion can be assured, product quality control can be easily secured, and various problems caused by over tightening excluded. Further, as the rotational range of the rotational member can be appropriately changed by the adjusting bolt of the rotational stopper, the present device can be applied to the installation of various bands for bundling by adjusting the adjusting bolt at an optimum protrusion amount, even if the kind of band is changed and the length of the band portion and the like is changed.

Further, as the present device can carry out an appropriate fastening of a band and, simultaneously, the cutting and removal of an excess portion of the band portion by only one operation of rotating a rotational member, problems and time required for the operation are reduced, and it can be designed to make the bundling and installation work of banding efficient. Additionally, since the sandwiching of the band portion is carried out by a sandwiching procedure which is not effected by the holding force of a worker, no circumstance occurs wherein the sandwiched band portion may slip off. Further, as the cutting blade does not extend above the upper face of the base member and is not exposed externally, the safety of the work can be secured. Accordingly, when the present device is provided on an assembly board, the positioning of the installation area to a group of electric wires constituting a wire harness is also positively carried out.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to subject matter contained in priority Japanese Application No. 2000-165424, filed on Jun. 2, 2000, which is herein expressly incorporated by reference in its entirety.

What is claimed is:

1. A band tightening and cutting device for fastening and cutting a band that bundles a group of electric wires forming a wire harness, said device comprising:

a base member having a band-retaining portion;

a band pulling mechanism provided on said base member, said band pulling mechanism including a substantially L-shaped member having a vertical member and a horizontal member provided on an upper face of said base member, a rotational member mounted on said vertical member in a freely rotatable manner, and a band holding member provided on said rotational member, said band pulling mechanism rotates said holding member relative to said substantially L-shaped member and to said base member and pulls a band portion to tighten the band; and a cutting blade provided on said base member, said cutting blade being movable toward said band retaining portion in response to movement of said band pulling mechanism;

wherein a band base portion of the band is retained by said band-retaining portion with the band portion bundled around the electric wires when the band is held by said holding member.

2. The band tightening and cutting device as set forth in claim 1, wherein;

said band-retaining portion includes a notch in an end of said base member.

3. The band tightening and cutting device as set forth in claim 2, said band pulling mechanism further comprising:

a sliding member provided on the horizontal member of said substantially L-shaped member movable in an upward and a downward direction, said sliding member including a pressure member;

said band holding member and said pressure member are provided on said rotational member; and said cutting blade having a cam part on an upper side and being slidable in a recessed portion in said base member;

wherein the band portion is pulled by rotation of said rotational member, said sliding member is moved downwardly by being pressed by said pressure member in response to the rotation to contact said cam part of said cutting blade so that said cutting blade is moved toward said band-retaining portion to cut an excess portion of the band.

4. The band tightening and cutting device as set forth in claim 2, wherein;

said L-shaped member is rotatably mounted on said base member and biased by a spring in a direction in which said band-retaining portion is closed; and said L-shaped member being able to rotate against the biased direction to an open position to insert the band base portion of the band in the band-retaining portion.

5. The band tightening and cutting device as set forth in claim 2, further comprising a lever provided on said rotational member, and an adjustable stopper provided on said L-shaped member, wherein said lever contacts said stopper during rotation of said rotational member to control the amount of rotation of said rotational member.

6. The band tightening and cutting device as set forth in claim 1, wherein said band-retaining portion comprises, a pair of generally triangular shaped protrusions extending from a lower face of said base member;

a notched portion on an end of said base member between said pair of generally triangular shaped protrusions; and a block provided on the lower face of said base member, said block having a pair of generally triangular shaped protrusions and a notched portion therebetween, said notched portion being coextensive with said notched portion of said base member;

wherein said pair of generally triangular shaped protrusions on said block are spaced from said pair of generally triangular shaped protrusions on said base member so that blade parts of a band are receivable in said space and a band base portion of a band is receivable in said notched portions to hold the band for tightening and cutting.

7. The band tightening and cutting device as set forth in claim 6, wherein said band-retaining portion further comprises;

a detection probe provided on said block and projecting into said notched portion of said block that detects insertion of a band base portion into said band-retaining portion.

8. The band tightening and cutting device as set forth in claim 1, wherein said band holding member comprises:

a fixed holding member provided on said rotational member and including a pressure face;

a rotational holding member rotatably mounted on said fixed holding member and including a pressure face; and a spring having one end fixed to said rotational member and another end fixed to said rotational holding member, wherein said spring biases said pressure faces together to hold a band portion therebetween.

9. The band tightening and cutting device as set forth in claim 2, wherein said L-shaped member further comprises:

a recessed portion provided on said vertical member and a recessed portion provided on said horizontal member adjacent said notched portions, and a U-shaped guide member provided on said vertical member in said recessed portion of said vertical member and said recessed portion of said horizontal member, said U-shaped guide member having an insertion guide portion that guides the band portion during the band tightening operation.

10. The band tightening and cutting device as set forth in claim 1, wherein;

said base member is provided on an upper end of a support bar that projects from an assembly board.

11. A method for fastening and cutting a band that bundles a group of electric wires forming a wire harness, said method comprising:

providing a band tightening and cuffing device;

providing a band having a band portion and a band base portion;

inserting said band base portion in a band retaining portion of said band tightening and cutting device;

encircling a group of wires with said band and inserting an end of said band portion into said band base portion;

holding said band portion with a holding member of said band tightening and cutting device, said band tightening and cutting device including a band pulling mechanism including a substantially L-shaped member having a vertical member and a horizontal member provided on an upper face of a base member, a rotational member mounted on said vertical member in a freely rotatable manner, said holding member provided on said rotational member; and rotating said holding member and said band portion held thereby relative to said substantially L-shaped member and to said base member so that said band portion is pulled away from said band base portion and said band is tightened around said wires.

12. The method for fastening and cutting a band as set forth in claim 11, said method further comprising:

moving a cutting blade on said band tightening and cutting device in response to said rotating and thereby cutting an excess portion of said band;

whereby fastening and cutting of said band takes place in a single operation.

* * * * *